US005721013A

United States Patent [19]

Pratt

[11] Patent Number: 5,721,013

[45] Date of Patent: Feb. 24, 1998

[54] CUSTOM GLUE CHIPPED GLASS PROCESSOR AND METHOD

[76] Inventor: Barbara E. Pratt, 4724 Watkins Ave., Sarasota, Fla. 34233

[21] Appl. No.: 494,409

[22] Filed: Jun. 26, 1995

[51] Int. Cl.[6] ..... B05D 5/00

[52] U.S. Cl. ..... 427/280; 427/287; 427/274; 427/275; 216/31

[58] Field of Search ..... 118/64, DIG. 7, 118/58, 326; 427/274, 275, 280, 287, 271; 216/31

[56] References Cited

U.S. PATENT DOCUMENTS

| | | | |
|---|---|---|---|
| 4,173,924 | 11/1979 | Bradshaw | 118/326 |
| 4,323,423 | 4/1982 | Schrunk | 216/31 |
| 4,427,729 | 1/1984 | Messer | 428/141 |

*Primary Examiner*—Katherine A. Bareford
*Attorney, Agent, or Firm*—Wyatt B. Pratt

[57] ABSTRACT

An apparatus and method for the safe and controlled production of glue chipped glass. This custom glue chipped glass processor and method facilitate the production of glue chipped glass for either artisans creating highly specialized works of art, or beginners in the field.

9 Claims, 1 Drawing Sheet

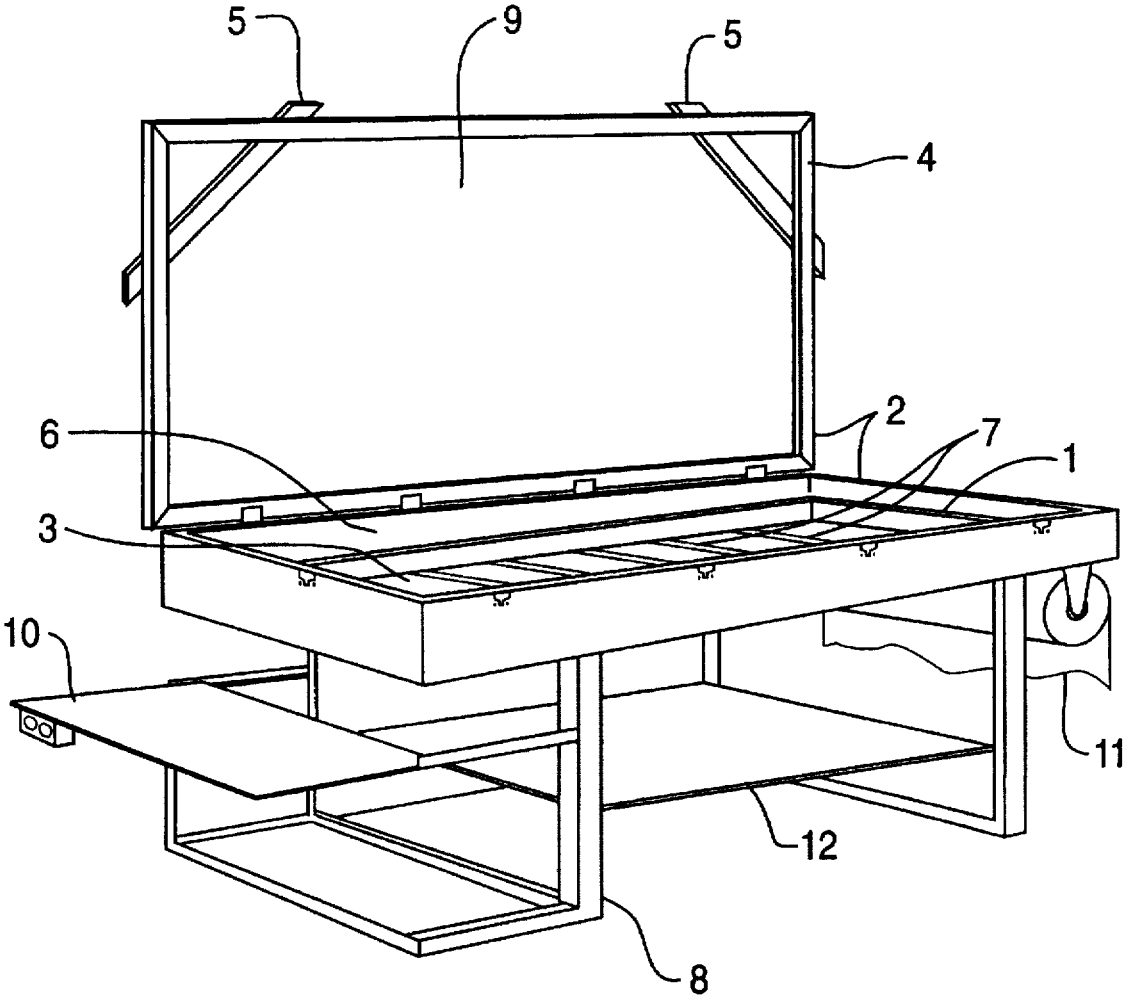
5
9
5
4
2
7
1
6
3
10
11
12
8

CUSTOM GLUE CHIPPED GLASS PROCESSOR AND METHOD

BACKGROUND OF THE INVENTION

1. Field of the Invention

The present invention provides a method for glass chipping involving the use of glue and glue-like substances on glass. More particularly, the method permits a safe method for glue chipping glass by individuals.

2. Description of the Related Art

The long known process is practiced by applying a solution of glue to a coarse glass surface. As a result of the glue constricting while drying, glass fragments chipping from the surface of the glass remove sections of the glass surface. This process creates a distinctive pattern on the glass panel to which the glue was applied.

Although practiced for a long period of time, the art of glue chipped glass remained accessible only to experienced artists and large scale operations, for reasons of cost, complexity and safety. The art required extensive expertise and caution by the artisans in carrying out the process. The art remained too complicated and sophisticated for elaborate or ordinary art pieces because of the large number of variables of the process which cause difficulty in obtaining a large percentage of successful outcomes in the glue chipped glass pieces. AS a result, large numbers of pieces are destroyed because of the lack of control of these variables.

One variation of the glue chipped glass art was discussed in Messer, U.S. Pat. No. 4,427,729, which permits the mass production of glue chipped glass in an open area. This apparatus and method is of value to the mass production of a glue chipped glass product, but does not advance the art for the artisan and beginner of the art. The complexity of the disclosed device of the Messer patent, and the open area, make this apparatus and method useful in large scale operations but not particularly useful for the artisan with custom or large scale pieces, or beginners of the art.

Other previous methods of this art only addressed the glue chipped glass art as carried out by artisans, who because of experience and resources, were able to ensure adequate standards of safety and control of variables affecting the formation of the glue chipped glass. Artisans had the knowledge to ensure safe handling for individual projects, even so the art remained dangerous for these experts, and many projects were inadvertently destroyed. Artisans would develop their own procedures for the safe handling of the art. Lacking in the history of this art is the significant development of safe environment within which artist may work.

The need for closely controlling the variables in the glue chipped glass process requires the glue chipped glass to generally be produced on a mass quantity scale. This process produces many stock sheets of glue chipped glass at one time. This glass is cut to size for standard commercial use or on small craft item pieces. Due to the standardized, small scale of these pieces, any damage becomes less of a concern because of replaceable pieces of similar quality. Most losses are small in number compared to the overall amount of glue chipped glass produced in the process.

Many small shop artisans have shied away from using the glue chipped glass process, especially in their more expensive and hard to handle pieces, such as table tops, mirror wall panels, and bevel strips, because of the difficulty in controlling the variables of glue chipping. Many attempts to chip these items resulted in inadequately chipped, damaged or broken pieces. Labor losses increase significantly since any pieces require two or more skilled glaziers to move these larger and bulky glass items. This large effort and percentage loss is often unacceptable to any small shop artisans. Many of these artisans decline to even attempt to use the process in their normal course of business.

An important object of the custom glue chipped glass processor and method is to secure an environment in which a user can indulge in the art of glue chipped glass in a safe, controlled, inexpensive, proficient and competent manner. It also allows for more freedom of design in the artwork attempted on the glass. Users can combine mediums such as stained, painted, or carved glass with the glue chip in any given piece, which mass quantity production does not allow.

An important object of the custom glue chipped glass processor method is the containment of the process in one area which increases the safety of the process to users and observers. A protective barrier prevents injury to the users, the glass and observers throughout the complete process.

A further important object of the custom glue chipped glass processor and method is the ability of the user to select the most appropriate type of drying and heating elements increasing safety and comfort of users, and control of the chipping process.

A further important object of the custom glue chipped glass processor and method is the absence of intricate mechanical parts increasing the safety of users.

A further important object of the custom glue chipped glass processor and method is the containment of the chipping glass particles which shatter away from glass, lessening the risk of injury to users and observers.

A further important object of the custom glue chipped glass processor and method is the containment of the complete process in one area, reducing the need to move glass or chemicals, and reducing the risk of injury to users or observers, and damage to glass.

A further important object of the custom glue chipped glass processor and method is the optional feature of a viewscreen, which permits safe viewing for educational benefits and the emotional satisfaction to users and observers to observe each stage of the process.

A further important object of the custom glue chipped glass processor and method is the variable height and size capabilities, which aid in the safe and proper fitting of the glass, reducing injury from unbalanced lifting of the glass, chemicals or other materials.

A further important object of the custom glue chipped glass processor and method is the optional absence of any artificial heat or dehumidifying source, which reduces the risk of burns or other injury to the users and observers.

A further important object of the custom glue chipped glass processor and method is the ability of skilled artisans using a more simplistic procedure while maintaining the complexity of their art.

A further important object of the custom glue chipped glass processor and method is to allow artistic freedom to both the artisan and beginner to perform and perfect complicated procedures of glue chipped art and to integrate glue chipping with other art forms.

A further important object of the custom glue chipped glass processor and method is the raised platform for positioning the glass plate, increasing the ease of handling and the safety of the process.

A further important object of the custom glue chipped glass processor and method is the complete unit in one area, which not only reduces the need for the user to move the operation from one area to another, it also reduces the tendency of the users from wanting to move the operation to another area, decreasing further the likelihood of injury to the users or breakage of glass.

A further important object of the custom glue chipped glass processor and method is to permit beginners in the art, as well as artisans, extensive experimentation in the art of glue chipped glass at a significant reduced cost.

A further important object of the custom glue chipped glass processor and method is the constant and reliable results that are attainable by users in the art of glue chipped glass.

Another important object of the custom glue chipped glass processor and method is the ease of disposal of any toxic or hazardous chemicals, such as glue or drying chemicals, involved in the process, further aided by the use of removable matting.

SUMMARY OF THE INVENTION

The previously stated objectives are accomplished by the present invention by use of an apparatus designed to contain the process through which the glass is subjected to glue chipping. The glass plate is placed horizontally and level on supports within a work area, and the glass can be "roughed" to provide a suitable surface on which to place the glue. Drying chemicals also can be added into the work area while the glass is already in the container, and glue can be applied to the surface of the glass. After the application of the glue, the work area can be sealed without the need to move the glass. Vents on the sides, top or bottom of the work area allow the operator adjust drying agent in the work area, while avoiding the danger of the chipping glass. The full and open view of the glass in the work area through the viewscreen allows the operator to measure and time the progress of the glue chipping. The ease of the lid seal allows the operator to regulate the process by opening the lid and stopping the process. Once dried, the glass is removed from the work area. The work area is cleaned with the removal of the disposable matting in the work area. With the replacement of the matting in the work area, the work area is immediately ready for another use. The apparatus may be used either inside a room, or outside of any building structure.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein examples of the invention is shown and wherein:

FIG. 1 is a corner perspective view illustrating apparatus for facilitating the process of custom glue chipped glass.

DESCRIPTION OF A PREFERRED EMBODIMENT

The apparatus facilitates the use of the glue chipped art by users with a degree of safety, predictability and variation control unknown to the art. This is done by use of a single area, safe work environment for users of the art. This environment is an apparatus that contains the complete glue chipping process. It is made of wood, plastic or any other materials which can safely contain chipping glass. The reduction of moving parts, the elimination of open work areas, the lessening of the need to transverse work areas, and the minimum cost of this apparatus permit this art to be practiced by users much more extensively than currently practiced. This becomes possible because of the increase in safety and the consistent reliable results of the process when the glue chipped glass processor is used by users.

The glue chipped glass processor provides a work area which is protected by a protective barrier shielding, a lid attached to the protective shielding, and optionally, at least one opening within the protective barrier to allow access to the work area without opening the lid. The processor is mounted on a table top. The processor has a means for dehumidifying the work area. A base is attached to the work area to support it. The base may be in the form of a leg. The lid forms a sealed work area when it is closed. An opening allows access into the work area with the lid closed, and the processor may have a viewscreen to view the work carried on the piece of glass. The work area may have matting on the bottom to facilitate working the glass. Adjustable supports may be used to vary the level of the glass in the horizontal position in the work area. Heating, drying, and other environmental control may be made part of the processor to help with the working of the glass. Handles to enable easier movement of the processor by an artisan and any device to allow glass movement, especially by a single artisan, is contemplated with the invention.

As seen in FIG. 1, the glue chipped glass processor apparatus has a work area 6, protective barrier shielding 2 supported by a base 8, and a lid 9 optionally with a viewscreen, attached to the protective barrier shielding 2. The base 8 may be any support which allows the positioning of a piece of glass to be glue chipped in a horizontal position within the work area 6. FIG. 1 shows a glass piece 1, drying material 3, environmental sealing or weather stripping 4, handles positioned to prevent warping of the lid 5, bumpers for easy handling of the glass 7, retractable utility shelf with electrical outlet 10, holder and cutter for plastic liner or matting 11, and a work shelf 12. Supports are located within the work area to steady the glass and to permit movement of the glass during the glue chipping. Supports may be located in the apparatus to permit stacking of glass pieces, and drying agents may be placed throughout the apparatus. Additional shelves may be placed in conjunction with the processor to allow for staging of work materials and other items to permit the artist to complete the glue chipping. Any mechanical or other means may be used to dehumidify the work area. Additionally, an opening in the processor allows access to the glass work piece without the necessity of opening the lid, allowing for safer and more efficient manipulation of the glass work piece.

While there are many variations to the apparatus, these variations allow the general use of the apparatus by individuals, and are varied according to the individual needs of the specific users of the apparatus. Variations in the placement of openings may be used to tailor the apparatus to a certain room, or to a particular individual, for instance a left or right handed person. The absence of the viewscreen may reduce the price of the apparatus when the educational or emotional benefits of the apparatus are not enhanced by the addition of this feature. Sizes and heights may vary as the need arises, which may be accomplished by fixed or variable components of the apparatus to allow the user to adjust the support of the apparatus at any particular time. One apparatus may have more than one level on which to place additional works of glass, and on which the user may work on the glass while other piece remain in the work area.

The complete apparatus is designed for the safe and predictable use by users. Features which are used to enhance the safety of the apparatus may be eliminated when that elimination increases the safety for a particular user. As a safe way for a beginner to engage in the art of glass chipping, the apparatus be may altered in any of its component parts to increase safety. For example, a closing lid that would be too heavy for one individual would be changed to a sliding top. Installed locks would be used in a classroom setting to eliminate the possibility of unapproved access into the apparatus by children. The features strike a balance to allow users and artists to produce a product in relative safely compared to the current practice of glue chipped glass.

Within the work area of the present invention, level supports are used to steady the glass in a horizontal and level position to allow an even layer of glue. In situation where a level area is not required for glue to dry on the surface, these supports may be altered to the desires of the user. Shelving within the work area allows for the placement of drying chemicals or other drying and dehumidifying mediums, as well as for placement of tools or other items. Supports under the glass permit handling of the glass sides, and assist in the ease of lifting or shifting the glass. The work area is optionally placed on its own legs which can tilt or permit adjustments in height, allowing ease of lifting the glass in and out of the apparatus. Once in the work area, the apparatus has a sealable top with which to seal the environment in the apparatus. Viewscreens would allow viewing of the glass within the apparatus.

While the preferred embodiment of the invention has been described using specific terms, such description is for illustrative purposes only, and it is to be understood that changes and variations may be made without departing from the spirit or scope of the following claims.

What is claimed is:

1. A method of making glue chipped glass comprising the steps of:

(a) providing an apparatus, mounted on a level table top, having a barrier which defines an enclosed area, a work area within the enclosed area capable of supporting a glass piece, and a means for sealing the work area;

(b) placing the glass piece within the apparatus;

(c) applying glue to the glass piece; and, (d) dehumidifying the enclosed area thereby facilitating drying of the glass piece within the apparatus.

2. The method of claim 1, further including the step of:

sealing the glass piece within the apparatus.

3. The method of claim 1, further including the step of:

roughening the glass piece prior to applying glue thereon.

4. The method of claim 1, further including the step of:

placing drying chemicals within the apparatus as dehumidifying agents.

5. The method of claim 1, further including the step of:

hardening the applied glue prior to dehumidifying the enclosed area.

6. The method of claim 1, further including the step of:

positioning the glass piece on supports within the apparatus while placing the glass piece within the apparatus.

7. The method of claim 1, further including the step of:

placing matting at the base of the apparatus prior to placing the glass piece within the apparatus.

8. The method of claim 1, further including the step of:

drying the glue with a heating device.

9. A method for creating artistic design patterns on pieces of glass, comprising:

providing an apparatus, mounted on a level table top, having a barrier which defines an enclosed area, a work area within the enclosed area capable of supporting a glass piece, and a means for sealing the work area; and, placing the glass piece within the apparatus;

roughening selected areas on the glass piece;

applying glue to the roughed areas on the glass piece; and, dehumidifying the enclosed area to dry the applied glue.

* * * * *